US005106560A

United States Patent [19]

Duffy et al.

[11] Patent Number: 5,106,560

[45] Date of Patent: Apr. 21, 1992

[54] PRODUCING PARA-ARAMID PULP BY MEANS OF GRAVITY-INDUCED SHEAR FORCES

[75] Inventors: Joseph J. Duffy, Newark, Del.; Jon D. Hartzler, Midlothian, Va.; Robert A. Marin, Hockessin, Del.; Richard D. Mules, Wilmington, Del.

[73] Assignee: E. I. Du Pont de Nemours and Company, Wilmington, Del.

[21] Appl. No.: 564,147

[22] Filed: Aug. 9, 1990

[51] Int. Cl.[5] ..... B29C 39/14

[52] U.S. Cl. ..... 264/144; 162/157.3; 264/212; 264/299; 264/233; 264/37; 264/331.19; 425/224

[58] Field of Search ..... 264/142, 143, 212, 213, 264/214, 299, 180, 184, 331.19, 144, 145, 108, 148, 233, 37; 528/348; 425/224; 162/157.3

[56] References Cited

U.S. PATENT DOCUMENTS

| | | | |
|---|---|---|---|
| 2,485,249 | 10/1949 | Weir | 264/143 |
| 3,767,756 | 6/1972 | Blades | 264/184 |
| 4,389,357 | 6/1983 | Chu et al. | 264/212 |
| 4,511,623 | 4/1985 | Yoon et al. | 428/359 |
| 4,737,407 | 4/1988 | Wycech | 264/143 |
| 4,814,120 | 3/1989 | Huc et al. | 264/28 |
| 4,876,040 | 10/1989 | Park et al. | 264/14 |
| 4,893,999 | 1/1990 | Chmelir et al. | 264/212 |

FOREIGN PATENT DOCUMENTS

| | | | |
|---|---|---|---|
| 348996 | 1/1990 | European Pat. Off. | 528/348 |

OTHER PUBLICATIONS

Fluid Flow, 2nd Edition, Sabersky et al., MacMillan, 1971, pp. 9–11.

Transport Phenomena, Bird et al., John Wiley, pp. 34–43.

*Primary Examiner*—Jeffery Thurlow

*Assistant Examiner*—Mathieu Vargot

[57] ABSTRACT

A method for producing para-aramid pulp by using gravity-induced orientation of anisotropic para-aramid solutions. The solutions are those in which the para-aramid is still actively polymerizing. The process can be practiced on immobile inclined supports or on a moving inclined support in the form of a conveyer.

29 Claims, 2 Drawing Sheets

PRODUCING PARA-ARAMID PULP BY MEANS OF GRAVITY-INDUCED SHEAR FORCES

BACKGROUND OF THE INVENTION

The present invention relates to a method for producing para-aramid pulp by means of gravity-induced shear forces and pulp made thereby.

The demand for para-aramid pulp such as the poly(p-phenylene terephthalamide) pulp sold under the trademark Kevlar ® by E. I. du Pont de Nemours & Co. has been steadily increasing. Due to its high temperature stability, strength and wear resistance, para-aramid pulp is increasingly being used in brake linings and gaskets to replace asbestos. Para-aramid pulp is used in newly-developed papers, laminates and composites for applications requiring high strength and temperature stability; and para-aramid pulp is finding use as a reinforcing agent in composite elastomer structures such as in tires and hoses and the like.

U.S. Pat. No. 4,876,040 issued Oct. 24, 1989 on the application of Park et al., discloses a process for making pulp-like short fibers of aromatic polyamide by extruding a prepolymer dope into a coagulating liquid under shear conditions between the dope and the coagulating liquid.

U.S. Pat. No. 4,511,623 issued Apr. 16, 1985 on the application of Ycon et al., discloses a process for making pulp-like para-aramid fibers using a catalyzed, high-speed, high shear reaction with polymer of an inherent viscosity of greater than 5.0 dl/g.

Most para-aramid pulp is produced by spinning oriented, continuous fibers of the para-aramid polymer in accordance with a dry-jet wet spinning process such as that disclosed in U.S. Pat. No. 3,767,756 and then mechanically converting the fibers into pulp. The spinning of para-aramid fibers is an expensive and complicated process. U.S. patent application Ser. No. 07/358,811 filed June 5, 1989, now U.S. Pat. No. 5,028,372, in the name of Brierre et al. discloses a process for producing para-aramid pulp by means of extruding a polymerizing anisotropic solution of para-aramid, incubating the extruded solution to achieve a sufficient para-aramid molecular weight to gel the solution, cutting the gel, and isolating pulp from the gel. The extrusion in that process is necessary to achieve an orientation of para-aramid polymer molecules necessary for obtaining the pulp. Because the solution to be extruded is actively polymerizing, there is a tendency for the die to foul with stagnant polymer at the interface between the die and the solution.

SUMMARY OF THE INVENTION

The present invention provides a method for producing para-aramid pulp by means of gravitational forces. Para-aramid pulp is made by establishing a polymerizing para-aramid solution, pouring the solution on an inclined support having an angle with the horizontal adequate to cause flow of the solution and with a length adequate to prevent overflow of the solution, maintaining the solution on the support until the solution gels and isolating para-aramid pulp from the gel. The gel can be cut at selected intervals transversely with respect to the flow of the solution before isolating the pulp, if desired.

The invention, also, provides an apparatus for producing an oriented gel of polymer comprising a continuously renewable, longitudinal, support surface inclined from the horizontal; means adjacent the support surface for pouring the polymerizing polymer solution onto the support surface; means for moving the support surface to continuously present a new portion of the support surface to the poured polymer solution; means for maintaining the polymer solution on the support surface for a time adequate to permit polymerization of the polymer to continue until the solution becomes a gel; and means for removing the gel from the support surface.

There is, also, provided a process for determining the viscosity of a liquid solution by flowing the solution down an inclined support by gravity-induced forces, comprising the steps of determining the density of the liquid, the angle of inclination of the support, the surface velocity of the flowing liquid, the velocity of the inclined support (if moving), the volumetric liquid flow rate, and with width of the flowing liquid; and calculating the viscosity by solving the following equations:

$$V_{(s)} = V_{con} - \frac{dgh^2 \operatorname{Cos}B}{2m}$$

and $$Q = WV_{con}\, h - \frac{dgWh^3 \operatorname{Cos}B}{3m}$$ wherein

"g" is the gravitational constant of 980 cm/sec$^2$;

DETAILED DESCRIPTION OF THE INVENTION

Figure 1:
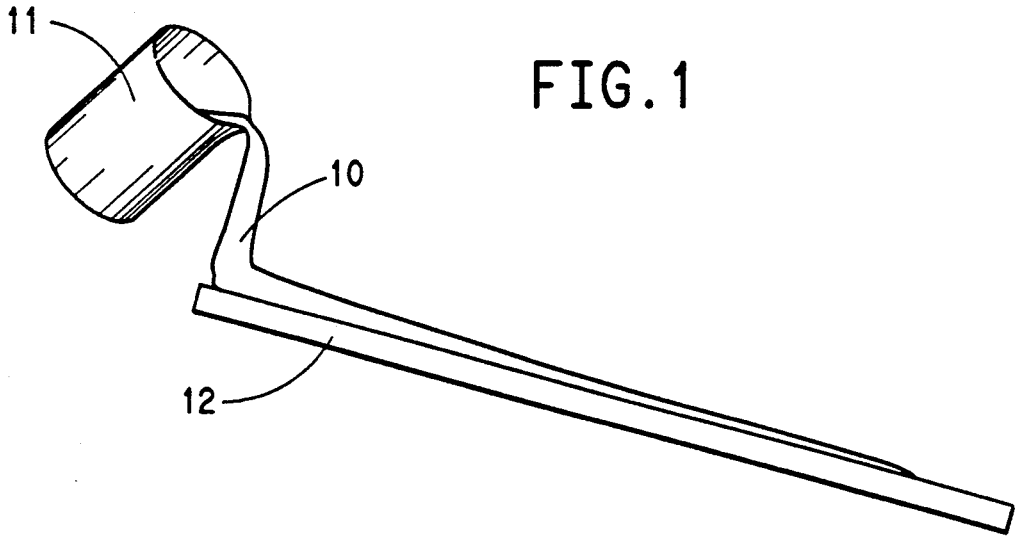
FIG. 1 illustrates the process of this invention as it might be practiced on an immobile inclined support.

In accordance with a preferred form of the present invention, the solution is poured onto an inclined support which is at an angle cf about 5 to 75 degrees with the horizontal and which is moving upward from the horizontal. The angle and movement are established to provide mean shear of about 1 to 35 sec$^{-1}$ and preferably 2 to 10 or perhaps as high as 15 sec$^{-1}$. In this form of the invention, the solution is maintained on the support until it gels and, in a preferred embodiment, is incubated thereon. The solution, once gelled, is cut transversely with the flow of the solution on the support. The gel is incubated in a manner, and under conditions, which will result in increased para-aramid molecular weight.

Para-aramid pulp is isolated from the transversely cut gel by, for example, being mechanically agitated in a liquid medium. The cut gel can be added to a mill containing an aqueous alkaline solution. In the mill, the gel is neutralized and coagulated and is simultaneously size reduced to produce a pulp slurry from which the pulp is easily recovered. Other acceptable liquid media include water, amide solvents, such as N-methyl pyrrolidone, and the like.

The method of this invention produces pulp directly from a polymerization reaction mixture without extrusion and eliminates the need for special extrusion equipment, materials, and processes. In accordance with the most preferred form of this invention, the para-aramid is a homopolymer—poly(p-phenylene terephthalamide).

The only chemicals needed for the method are p-phenylene diamine, terephthaloyl chloride, the polymerizing solvent system, and a coagulating liquid for isolating the pulp from the gel. The method of this invention is particularly well-suited for continuous pulp production on a commercial scale.

The para-aramid pulp product of this invention consists essentially of pulp-like short, fibrillated, fibers of para-aramid free of sulfonic acid groups and having an inherent viscosity of between about 2.0 and about 4.5 dl/g and having a width of between about 1μ to about 150μ, a length of between about 0.1 mm and about 35 mm, and a surface area of greater than about 2 $m^2/g$. Preferably, the pulp consists essentially of poly(p-phenylene terephthalamide) (PPD-T).

The term "para-aramid" in relation to this invention is intended to refer to para-oriented, wholly aromatic polycarbonamide polymers and copolymers consisting essentially of recurring units of the formula

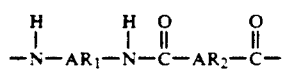

I wherein $AR_1$ and $AR_2$, which may be the same or different, represent divalent, para-oriented aromatic groups. By para-oriented is meant that the chain extending bonds from aromatic groups are either coaxial or parallel and oppositely directed, for example, substituted or unsubstituted aromatic groups including 1,4-phenylene, 4,4'-biphenylene, 2,6-naphthylene, and 1,5-naphthalene. Substituents on the aromatic groups other than those which are part of the chain extending moieties should be nonreactive and must not adversely affect the characteristics of the polymer for use in the practice of this invention. Examples of suitable substituents are chloro, lower alkyl and methoxy groups. The term para-aramid is also intended to encompass para-aramid copolymers of two or more para-oriented comonomers including minor amounts of comonomers where the acid and amine functions coexist on the same aromatic species, for example, copolymers produced from reactants such as 4-aminobenzoyl chloride hydrochloride, 6-amino-2-naphthoyl chloride hydrochloride, and the like. In addition, para-aramid is intended to encompass copolymers containing minor amounts of comonomers containing aromatic groups which are not para-oriented, such as, for example, m-phenylene and 3,4'-biphenylene.

The method for producing para-aramid pulp in accordance with this invention, includes contacting, in an amide solvent system, generally stoichiometric amounts of aromatic diamine consisting essentially of para-oriented aromatic diamine and aromatic diacid halide consisting essentially of para-oriented aromatic diacid halide to produce a polymer or copolymer in accordance with Formula I above. The phrase "consisting essentially of" is used herein to indicate that minor amounts of aromatic diamines and diacid halides which are not para-oriented and para-oriented aromatic amino acid halides can be employed provided that the characteristics of the resulting polymer for practice of the invention are not substantially altered. The aromatic diamines and aromatic diacid halides and para-oriented aromatic amino acid halides employed in this invention must be such that the resulting polymer has the characteristics typified by para-aramids and forms an optically anisotropic solution in the manner called for in the method of the invention and will cause the polymerization solution to gel when the inherent viscosity of the polymer is between about 2 and about 3 dl/g at the appropriate solution concentration.

In accordance with a preferred form of the invention, at least about 80 mole percent of the aromatic diamine is p-phenylene diamine and at least 80 mole percent of the aromatic diacid halide is a terephthaloyl halide, for example, terephthaloyl chloride. The remainder of the aromatic diamine can be other para-oriented diamines including, for example, 4,4'-diaminobiphenyl, 2-methyl-p-phenylene diamine, 2-chloro-p-phenylene diamine, 2,6-naphthalene diamine, 1,5-naphthalene diamine, 4,4'-diaminobenzanilide, and the like. One or more of such para-oriented diamines can be employed in amounts up to about 20 mole percent together with p-phenylene diamine. The remainder of the aromatic diamine may include diamines which are not para-oriented such as m-phenylene diamine, 3,3'-diaminobiphenyl, 3,4'-diaminobiphenyl, 3,3'-oxydiphenylenediamine, 3,4'-oxydiphenylenediamine, 3,3'-sulfonyldiphenylene-diamine, 3,4'-sulfonyldiphenylenediamine, 4,4'-oxydiphenylenediamine, 4,4'-sulfonyldiphenylenediamine, and the like, although it is typically necessary to limit the quantity of such coreactants to about 5 mole percent.

Similarly, the remainder of the diacid halide can be para-oriented acid halides such as 4,4'-dibenzoyl chloride, 2-chloroterephthaloyl chloride, 2,5-dichloroterephthaloyl chloride, 2-methylterephthaloyl chloride, 2,6-naphthalene dicarboxylic acid chloride, 1,5-naphthalene dicarboxylic acid chloride, and the like. One or mixtures of such para-oriented acid halides can be employed in amounts up to about 20 mole percent together with terephthaloyl chloride. Other diacid halides which are not para-oriented can be employed in amounts usually not greatly exceeding about 5 mole percent such as isophthaloyl chloride, 3,3'-dibenzoyl chloride, 3,4'-dibenzoyl chloride, 3,3'-oxydibenzoyl chloride, 3,4'-oxydibenzoyl chloride, 3,3'-sulfonyldibenzoyl chloride, 3,4'-sulfonyldibenzoyl chloride, 4,4'-oxydibenzoyl chloride, 4,4'-sulfonyldibenzoyl chloride, and the like.

Again, in a preferred form of the invention up to 20 mole percent of para-oriented aromatic amino acid halides may be used.

In the most preferred form of the invention, p-phenylenediamine is reacted with terephthaloyl chloride to produce homopolymer poly(p-phenylene terephthalamide).

The aromatic diamine and the aromatic diacid halide are reacted in an amide solvent system preferably by low temperature solution polymerization procedures (that is, less than 60° C.) similar to those shown in U.S. Pat. No. 4,308,374 in the names of Vollbracht et al. and U.S. Pat. No. 3,063,966 in the names of Kwolek et al. for preparing poly(p-phenylene terephthalamide). The disclosures of U.S. Pat. Nos. 3,063,966 and 4,308,374 are hereby incorporated herein by reference. Suitable amide solvents, or mixtures of such solvents, include N-methyl pyrrolidone (NMP), dimethyl acetamide, and tetramethyl urea containing an alkali metal halide. Particularly preferred is NMP and calcium chloride with the percentage of calcium chloride in the solvent being between about 4–10% based on the weight of NMP.

In establishing a liquid actively-polymerizing solution according to the present invention, low temperature solution polymerization is preferably accomplished by first preparing a cooled solution of the diamine in the amide solvent containing alkali metal halide. To this solution the diacid halide is added. While the diacid halide can be added all at once, it has been found to be preferred to add it in two stages. In the first stage, the diacid halide is added to the diamine solution cooled to between 0° C. and 20° C. until the mole ratio of acid halide to diamine is between about 0.3 and about 0.5. The resulting low molecular weight "pre-polymer" solution is then cooled to remove the heat of reaction. In the second stage, the remainder of the acid halide is added to the pre-polymer solution while agitating and cooling the solution, if desired. For a continuous process, a mixer such as is disclosed in U.S. Pat. No. 3,849,074, the disclosure of which is incorporated herein by reference, can be advantageously used for mixing the acid halide into the pre-polymer solution. The second stage addition is suitably carried out in an all-surface-wiped continuous mixer. As is known in this art, the reaction mixture is sensitive to moisture and it is desirable to minimize exposure to humid air and other sources of water.

In establishing the polymerizing para-aramid solution of this invention, it is desirable to achieve a carefully controlled reaction rate. Generally, polymerization catalysts are unnecessary for adequate polymerization and should not be used when they make the reaction rate more difficult to control. Nevertheless, the reaction rate must be sufficiently high that the solution gels within a reasonable time after being poured onto the inclined support so that orientation generated by the gravitational flow of the solution will not be lost before gelling and so that the solution will be gelled while still on the support. Typical reaction rates can be such that a time period on the order of 1-10 minutes is required for the thoroughly mixed liquid solution containing all reactants to gel to a "soft" gel. For a continuous process employing an all-surface-wiped mixer to perform the polymerization, control of the reaction of a solution with a certain concentration of reactants can be performed by adjusting the hold-up time in the mixer and/or the temperature of the solution.

Sufficient quantities of the diamine and diacid are employed in the polymerization to achieve a concentration of polymer in the resulting actively-polymerizing solution such that the solution is or becomes anisotropic during flow on the inclined support and ultimately forms a gel through continued polymerization. However, the solubility limits of the reactants in the solvent system should generally not be exceeded prior to pouring the solution onto the inclined support. For example, quantities of the diamine and diacid used to make PPD-T are preferably employed which result in a polymer concentration of between about 6.5% and about 11% by weight.

When the inherent viscosity of the para-aramid polymer is between about 0.5 and about 2.2 dl/g, preferably between about 0.7 and about 2 dl/g, and while the reaction is still continuing, the solution is poured onto the inclined support to cause a flow which produces an anisotropic condition in which domains of polymer chains are oriented in the direction of flow. The solution continues to polymerize during and after the flow initiated by the pouring step; and the pouring step should be initiated early enough that the inherent viscosity of the polymer is within the proper range when the solution is first subjected to the flow.

The step of pouring the solution onto an inclined support causes a flow of the solution adequate to orient the polymer solely due to the shear forces of gravity, including any movement of the inclined support. At least by the end of this step, the liquid solution is optically anisotropic, that is, microscopic domains of the solution are birefringent and a bulk sample of the solution depolarizes plane polarized light because the light transmission properties of the microscopic domains of the solution vary with direction. The alignment of the polymer chains within the domains is responsible for the light transmission properties of the solution. As the actively-polymerizing solution flows on the inclined support, the polymer chains in the solution become oriented in the direction of the flow.

It should be understood that the pouring of the liquid solution does not result in any orientation of the polymer. Pouring the solution, for purposes of this invention, means causing the liquid to flow out of a hole having only a slight thickness or causing the liquid to flow over a weir or out of a vessel without other restraint. Pouring does not cause orientation—orientation is caused by flow on the inclined support.

The flow which results from pouring the solution onto the inclined support, whether or not the support is moving, gives rise to a shear across the thickness of the solution. The mean shear in the solution due to that flow is less than about 35 $sec^{-1}$, preferably less than about 15 $sec^{-1}$, and most preferably from about 2 to 10 $sec^{-1}$. It is a surprising element of this invention that flow generating such low shear is effective to orient the para-aramid molecules to the extent necessary to make pulp. It was surprising that the shear resulting merely from gravitational flow is adequate to cause an orientation sufficient to yield a fibrous pulp product. Before this invention, it was believed that shear of at least 15 $sec^{-1}$ was necessary for pulp manufacture.

The flow of this invention is laminar, substantially unidirectional, and is entirely or substantially due to gravitational forces. To pour a viscous solution onto a stationary inclined support is to initiate purely gravitational flow. When the inclined support is in motion, the solution flow is still caused by gravitational forces. To visualize the infinitesimal contribution of any movement by the inclined support, one can think of a conveyer which is not inclined and one can easily conclude that solution poured onto the conveyer would be conveyed but would not flow. Due to the viscous nature of the solution, the flow caused by gravity in practice of this invention is laminar flow and is substantially unidirectional.

"Mean shear rate", as used herein, is intended to refer to the average shear rate. Shear rate can be thought of as the gradient of liquid velocity; and, for laminar flow induced by gravity on an inclined plane, shear rate is calculated from the following equation:

$$\text{Maximum Shear Rate} = \frac{dg \cos B\, h}{m}$$

where d = density of the liquid g = gravitational constant (980 cm/sec$^2$)

B = 90° minus angle of inclination with the horizontal h = depth of the liquid m = viscosity of the liquid Because the shear rate is a linear function of the liquid thickness; and because the shear rate can be seen to be zero when h equals zero at the free surface of the liquid, the Mean Shear is understood to be one-half of the Maximum Shear Rate. Mean Shear has been calculated in the Examples herein where Mean Shear is reported.

The depth and viscosity of the liquid are difficult to determine by direct measurement; and those values can be calculated by solving the following equations:

$$V_{(s)} = V_{con} - \frac{dgh^2 \cos B}{2m}$$

and $$Q = WV_{con}\, h - \frac{dgWh^3 \cos B}{3m}$$

where $V_{(s)}$=surface velocity of the flowing liquid $V_{con}$=velocity of the inclined support Q=volumetric liquid flow rate W=width of the flowing liquid Basis for the equations set out above can be found in "Transport Phenomena", R. B. Bird, W. E. Stewart, and E. N. Lightfoot, Chapter 2, pages 34–43, John Wiley & Sons, Inc., New York, incorporated herein by reference.

The oriented anisotropic solution formed during flow orientation is maintained on the inclined support for a time sufficient to permit polymerization to continue until the solution becomes a gel. Maintaining the solution on the inclined support may, also, include incubating the polymer. Maintaining the solution on the inclined support is only necessary until the solution gels to the point that it can be removed from the support; however, the gel can be incubated further on the support or after it has been removed therefrom. "Incubating" is intended to refer to the maintenance of conditions which result in continued polymerization and/or fibril growth and which maintain the orientation of the oriented anisotropic solution. The conditions for incubation can be varied as the incubation is continued. Incubation starts with orientation of the solution and ends with isolation of the pulp from the gel.

Incubation can commence when polymer chains in the anisotropic solution are oriented and remain oriented through increase in viscosity to gelation. During early incubation, the viscosity of the actively-polymerizing solution is in a range such that orientation of the polymer chains in solution will not become appreciably unoriented before the solution gels. The solution viscosity at the commencement of incubation can vary within a range dependent on the concentration and the inherent viscosity of the polymer in the solution. It is believed that a suitable viscosity range at the commencement of incubation generally corresponds to the viscosity of a poly(p-phenylene terephthalamide)-NMP-$CaCl_2$ solution with a polymer concentration of between about 6.5 and 11% and having an inherent viscosity of the polymer in the range of about 2 to about 3 dl/g. The polymerizing solution is poured onto the inclined support at anytime after all components of the solution have been combined and before the polymerization reaction has created a solution viscosity so high that the solution will not flow. In the process of this invention, all orientation of the polymer chains is achieved solely by flow of the solution on the inclined support. There is no orientation of polymer chains in the solution until the solution has been poured onto the inclined support and no significant orientation is accomplished merely by the pouring.

The temperature of the solution during flow (orientation) can be controlled to adjust the reaction rate and the solution viscosity. Until the solution gels, it is desirable for the temperature to be between about 25° C. and about 60° C. to maintain a high reaction rate. Most preferably, the temperature is maintained between about 40° C. and about 60° C. until the solution has become a firm gel. Above 40° C. a high reaction rate is achieved and it is believed that, above 40° C., better pulp formation in the gel also results. In the preferred embodiment employing a moving conveyer as the inclined support, incubation is commenced on the support as the solution contacts the support and is conveyed away from the point of pouring; and the solution is maintained on the support for a sufficient time so that the solution can gel. In order to decrease the time on the support, the solution on the support can be heated to reach the above-described temperature range and thus increase the reaction rate so that gelling on the belt occurs typically within a matter of minutes. Preferably, gelling to a degree that it can be cut, can be made to occur within about 2–8 minutes after the initiation of incubation.

After gelling, the gel is cut at selected intervals transversely with respect to flow of the solution. "Transversely" is intended to refer to any cutting angle which is not parallel with the flow of the solution. The transverse cutting of the gel is performed so that the maximum length of the pulp fibers can be controlled. In addition, it is believed that transverse cutting of the recently-gelled solution results in more uniform pulp fiber lengths. In the embodiment of this invention employing a moving conveyer, cutting in the transverse direction is suitably accomplished by cutting the gel into discrete pieces on the conveyer, or immediately after it leaves the conveyer, with a wire cutter having a cutting stroke proportional with the belt speed to assure uniformly cut lengths. Cutting the gel soon after gelling facilitates a continuous process using the moving conveyer since the conveyer belt length need only be long enough to provide time for the solution to gel. The gel is cut at intervals ranging from 5 to 35 mm and, preferably, less than about 25 millimeters. The gel is cut when it has hardened sufficiently that the gel pieces do not stick to the cutter and are not greatly disrupted during normal handling.

Incubation can be continued after cutting so that the polymerization can continue to increase the inherent viscosity of the polymer and facilitate the growth of pulp length. In order to minimize the time of the continued incubation, the temperature is preferably maintained above room temperature, preferably between 40°–55° C. The duration of continued incubation is variable depending on the product desired but should generally be longer than about 20 minutes at 40°–55° C.; and can be as much as 8 hours or more at those temperatures or higher. Continued incubation affects the size distribution of the pulp produced since continued incubation, in conjunction with cutting, increases the average length of the fibers in the pulp.

Additional incubation can be performed as a separate process step by storing the cut gel pieces at the elevated temperatures and the material can be consolidated in, for example, containers or on a slow moving conveyer, to decrease space requirements. Typically, the hardened gel pieces are stable and there is no need to employ special protective measures other than to prevent contact with water and with humid air.

Pulp is isolated from the cut gel after incubation. Isolation is accomplished by reducing the size of the material such as by shredding or grinding the gel and washing the resulting mass. The gel from which the pulp is isolated contains the polymerization bye-products, one of which is acid. Isolation of the pulp generally includes neutralization of that acid. Size reduction can be performed before or, preferably simultaneously with, neutralization. Size reduction and neutralization are suitably performed by contacting the gel with an alkaline solution in a mill or grinder; and it may also be useful to use a mechanical refiner. The pulp slurry produced is washed, preferably in stages, to remove the polymerization solvent and other constituents of the gel. Solvent can be recovered from both the neutralization solution and the wash water for reuse. The pulp slurry is dewatered, such as by vacuum filtration, and optionally dried, such as in an air-circulation oven. If desired, the pulp can be supplied in wet, uncollapsed, "never-dried" form containing at least about 30% water based on the weight of the dry pulp.

Referring, now, to the drawings, FIG. 1 illustrates the process of the present invention as it might be practiced on an immobile inclined support. Polymerizing para-aramid solution 10 is established, either in vessel 11 or elsewhere and then transferred to vessel 11. Vessel 11 is intended to represent, generally, a source of polymerizing solution, whether it be from an actual vessel or directly from a polymerizing reactor. Solution 10 is poured onto inclined support 12 and permitted to flow down the support until it gels. After solution 10 has gelled, it is cut transversely to the direction of flow and incubated.

Figure 2:
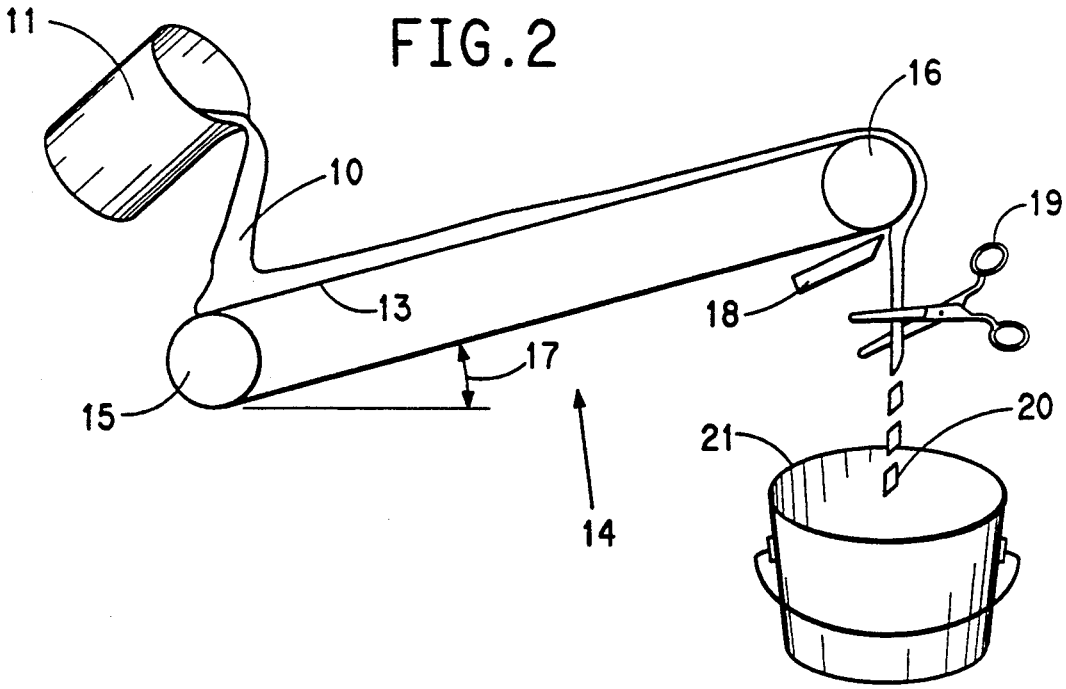
FIGS. 2 and 3 illustrate the process of this invention as it might be practiced on moving inclined supports.
Figure 5:
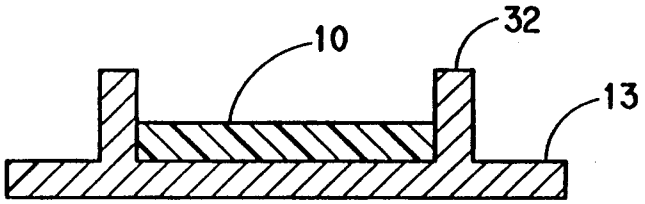
FIGS. 4 and 5 represent cross-sectional depictions of two embodiments of inclined supports.
Figure 4:
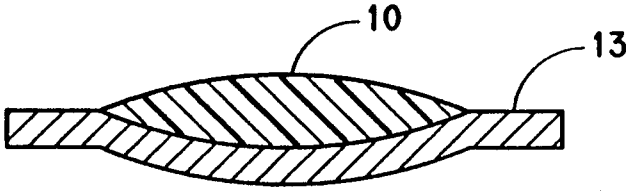

FIG. 2 shows an embodiment of this invention using a continuously renewable, moving, conveyer as the inclined support. In FIG. 2, solution 10 is poured from vessel 11 onto moving belt 13 of conveyer 14. Solution 10 can be poured continuously or not, as desired. Conveyer 14 includes rollers 15 and 16, at least one of which is driven for moving belt 13. Belt 13 is set at an angle 17 with the horizontal. Angle 17 can be from about 5 to 75 degrees. Belt 13 can be flat or concave or it can include a trough with walls to contain the solution. FIG. 4 shows a cross sectional representation of belt 13 made to have a slightly concave shape to assist in containing solution 10. FIG. 5 shows a cross sectional representation of belt 13 made with parallel, longitudinal, walls 32 defining a trough to assist in laterally containing solution 10. The lower limit for angle 17 is whatever angle which will permit substantially unidirectional flow of the solution. Less than 5 degrees does not cause adequate flow to accomplish the object of the process and more than 75 degrees gives rise to process control problems. When belt 13 is made to have a flat surface, the lower limit for angle 17 appears to be about 15 degrees.

In operation, as belt 13 moves upward, the viscosity of solution 10 increases by virtue of the continuing polymerization of the reactants in the solution; and at some point along belt 13, solution 10 gels and orientation of the polymer chains is frozen into the gelled material. Gelled solution 10 proceeds toward the top of conveyer 14, around roller 16 and, at doctor blade 18, is separated from belt 13. If additional length or time for gelling solution 10 is required, doctor blade 18 can be moved further down the underside of belt 13. Gelled solution 10 is cut transversely to the direction of flow by cutting means 19 positioned adjacent the support surface and cut pieces 20 are collected in container 21. Cutting means 19 is intended to represent, generally, any cutting means which can be used for the present purpose. Such cutting means may be taut wires, guillotines, blades, scissors, and the like.

Cut pieces 20 are incubated and the pulp of this invention is isolated by shredding or refining them, as previously disclosed herein. The length of conveyer 14 can be adjusted such that the gel can be incubated on belt 13 before being cut.

It is, also, possible to pour solution 10 onto belt 13 at the top of the conveyer, near roller 16, drive the rollers such that belt 13 moves downward, instead of upward; and, either stop the pouring when the solution reaches the end of the conveyer, or control the pouring such that the gelled solution can be removed from the belt at the bottom of the conveyer in the same way that it is removed from the belt at the top of the conveyer when run in the opposite direction.

Figure 3:
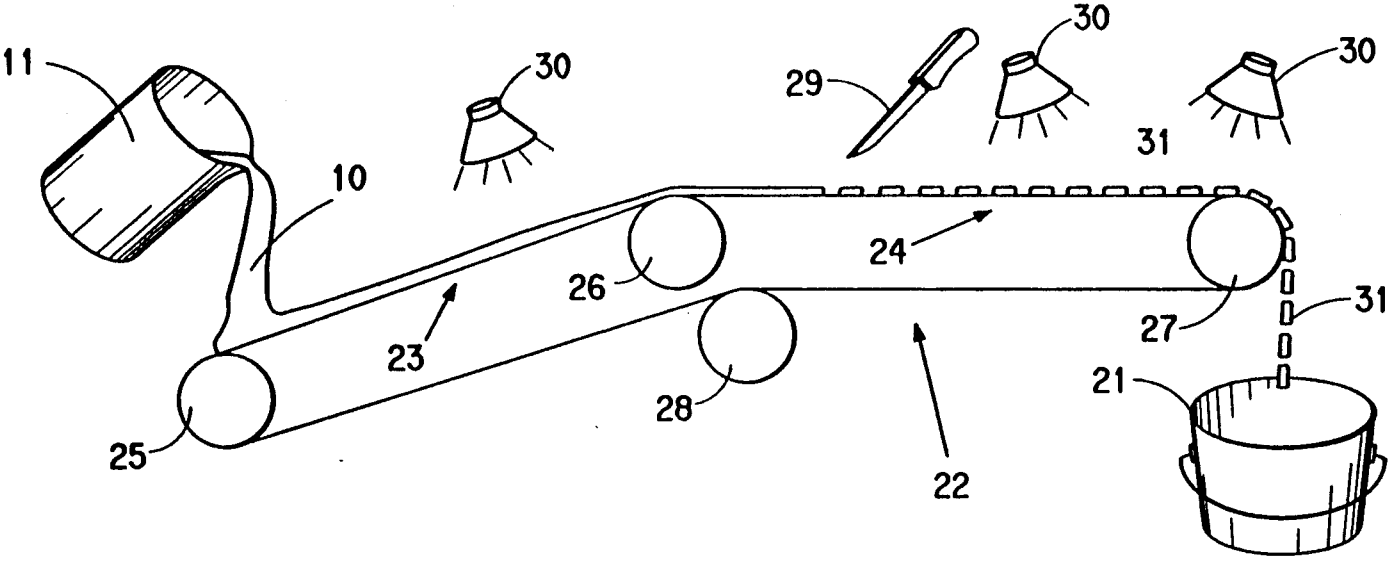

FIG. 3 shows an embodiment of this invention wherein conveyer 22 is divided into an inclined support section 23 and a horizontal section 24, both defined by rollers 25, 26, 27, and 28, at least one of which is driven. Solution 10 is poured from vessel 11 onto inclined support section 23 and the solution is gelled at any time before or slightly after the end of the section, at roller 26. Cutting means 29 is used to cut the gelled solution 10 on horizontal section 24 before or after operated incubation heaters 30, optionally used to assure appropriate incubation conditions. If it is desired or required for any particular reason, heaters 30 can be placed over solution 10 on the inclined support section 23 in the device of this FIG. 3 or over the inclined support sections of the devices of FIGS. 1 or 2. Cut pieces 31 of gelled solution 10 are removed from conveyer 22 at roller 27 and are collected in container 21 for isolation of the pulp. It is, also, possible to place the conveyer within an oven or the confines of heated blankets, with or without the added benefit of an inert gas, to maintain the gelled solution at an elevated temperature.

The pulp produced by the process of this invention consists essentially of short fibrillated fibers of para-aramid, preferably p-phenylene terephthalamide, having an inherent viscosity of at least 2 dl/g. Since the method does not involve spinning from a sulfuric acid solution, the para-aramid is free of sulfonic acid groups. The width of the pulp-like fibers produced in this process range from less than 1 micron to about 150 microns. The length of pulp-like fibers produced in this process may range from about 0.1 mm to about 35 mm, but will never exceed the interval of the transversely cut gel. The pulp is also characterized by fibrils having a wavy, articulated structure. Surface area of this product measured by gas adsorption methods is greater than about 2 $m^2/g$ versus that of an equivalent amount of unpulped, spun fiber of less than 0.1 $m^2/g$ indicating a high level of fibrillation.

When the pulp is not dried to below about 30% water based on the weight of the dry pulp ("never-dried"), the pulp fiber has an uncollapsed structure which is not available in pulp produced from spun fiber.

The pulp product of this invention, when used in customary applications, such as friction products and gaskets, provides performance substantially equivalent with pulp made by conventional techniques, that is, by cutting and refining of spun fiber even though the inherent viscosity of the polymer in the pulp of this invention may be lower than that in pulp produced from spun fiber.

The examples which follow illustrate the invention employing the following test methods.

Test Methods

Inherent Viscosity

Inherent Viscosity (IV) is defined by the equation:

$$IV = \ln(\eta_{rel})/c$$

where c is the concentration (0.5 gram of polymer in 100 ml of solvent) of the polymer solution and $\eta_{rel}$ (relative viscosity) is the ratio between the flow times of the polymer solution and the solvent as measured at 25° C. in a capillary viscometer. The inherent viscosity values reported and specified herein are determined using concentrated sulfuric acid (96% $H_2SO_4$).

Surface Area

Surface areas are determined utilizing a BET nitrogen absorption method using a Strohlein surface area meter, Standard Instrumentation, Inc., Charleston, W.V. Washed samples of pulp are dried in a tared sample flask, weighed and placed on the apparatus. Nitrogen is absorbed at liquid nitrogen temperature. Adsorption is measured by the pressure difference between sample and reference flasks (manometer readings) and specific surface area is calculated from the manometer readings, the barometric pressure and the sample weight.

Length and Width Measurements

About 5 milligrams of dried and loosened pulp are teased and spread out. The fiber lengths and widths are measured using a 10–70 power microscope with a precision millimeter reticle.

Suspension Depth

One-half gram of dried pulp is placed in a one-liter blender jar along with 150 milliliters of water, and the pulp is soaked for 30 seconds. The blender is operated for 2 minutes at about 13,500 rpm. The contents of the blender are transferred to a 250 milliliter glass beaker; and residual pulp fibers are rinsed from the blender jar with a few milliliters more of water. After about 2 minutes, the settled height of the suspended layer of pulp is measured in millimeters to provide the suspension depth.

The glass beaker has an internal diameter of about 63 millimeters and the height of the water column in the beaker is about 50 millimeters.

Suspension depth is believed to be a measure of the degree of fibrillation and length to width ratio (L/W) for the pulp product of this invention. For purposes of this invention, pulp exhibiting a suspension depth of greater than 20 millimeters has been considered to be acceptable.

Description of Preferred Embodiments Preparation of Poly(p-phenylene terephthalamide) solutions.

In the following examples, pulp is made in accordance with the process of this invention. The process requires the use of an actively polymerizing solution of para-aramid polymer which is of a proper inherent viscosity and solution concentration to be anisotropic under conditions of laminar flow at very low mean shear. The solution is made as follows (parts are parts, by weight), either on a batch or continuous basis:

A solution of calcium chloride (42 parts) in anhydrous N-methyl pyrrolidone (513 parts) is prepared by stirring and heating at about 90° C. After cooling the solution to about 25° C. in a dry nitrogen purge, 29.3 parts of p-phenylene diamine is added with mixing and the resulting solution is cooled to about 10° C. A first portion of anhydrous terephthaloyl chloride (TCl) (19.25 parts) is added with stirring. After dissolution of the first portion of TCl, the solution is cooled to a temperature of −5 to 30° C. and the remaining portion of TCl (35.75 parts) is added with vigorous mixing until dissolved. Vigorous mixing is continued during the resulting polymerization.

When the inherent viscosity of the polymer in the still-polymerizing mixture is above about 0.5 dl/g, the solution is poured onto an inclined support to commence the process.

The procedure, above, is for preparation of a solution wherein the polymer concentration is 10%, by weight. If solutions of different concentrations are desired, the amount of solvent can be adjusted accordingly; and the characteristics of the solution may vary from those described above.

EXAMPLE 1

In this example, pulp was made by the process of this invention using an inclined support having an adjustable angle with the horizontal. The actively-polymerizing solution described above was poured onto the support while the support was set at a variety of angles. The support was a flat plate made of stainless steel and was similar to that shown in FIG. 1.

A portion of the solution was transferred directly from the mixer and held in a vessel at the top of the inclined support for a time indicated in the Table, below, to permit a degree of continued polymerization. After the indicated time of continued polymerization, the solution was poured onto the support and it flowed down the support until the solution gelled and the viscosity became so high that it would no longer flow. The gelled solution was cut at about ½ inch intervals transversely to the direction of the flow. The pieces of cut gel were placed in an oven where they were heated at about 45° C. for about 60 minutes.

Acceptable pulp was isolated from the cut gel for all of the times and inclination angles tested (Items 1–6 of the table, below) by immersing the gel in water in a Waring Blendor cup and operating the Blendor at high speed for several minutes. The resulting pulp was filtered, immersed in water, and stirred in the Blendor for a short time four additional times and then dried. Inherent viscosity was determined on the polymer of the dried pulp product.

| Item | Solids (%) | Time (sec) | Angle (deg) | Flow Distance (cm) | Inherent Viscosity dl/g |
|---|---|---|---|---|---|
| 1 | 10.7 | 16 | 60 | 96 | — |
| 2 | " | 23 | 60 | 81 | 2.9 |
| 3 | " | 40 | 60 | 53 | 3.2 |
| 4 | " | 16 | 75 | >107 | 2.8 |
| 5 | " | 23 | 75 | — | 2.9 |
| 6 | 9.2 | 20 | 45 | — | — |

EXAMPLE 2

In this example, pulp was made by the process of this invention using an inclined support in the form of a conveyer similar to that shown in FIG. 2. The surface of the conveyer was made from a fluoropolymer to facilitate removal of the gelled solution; and the conveyer was about 1.5 meters long and was set at various angles with the horizontal.

A PPD-T solution, as described above but at a polymer concentration of 9.6%, was poured at a rate of about 16.4 grams per second onto the bottom of the conveyer. The conveyer was set to move at various speeds; but always fast enough to prevent the solution from running off of the lower end of the conveyer as the solution was poured. When the poured solution reached the top of the conveyer, the pouring was stopped and the conveyer was stopped. The solution was permitted to run back down the conveyer until it gelled and the viscosity was so high that it would no longer flow. About two minutes after stopping the conveyer, the gel was cut at intervals of about 1 to 2 centimeters transversely to the solution flow and the cut gel was transferred from the conveyer to an oven where it was heated at about 45° C. for 60 minutes.

Acceptable pulp (Items 1-8 of the table, below) was isolated from the gel by the same technique as was described in Example 1, above.

| Item | Angle (deg) | Exit Inh* | Conv. Speed (cm/s) | Inherent Viscosity dl/g | Suspension Depth, (mm) |
|---|---|---|---|---|---|
| 1 | 45 | 1.34 | 16.3 | 3.28 | 51 |
| 2 | 45 | 1.34 | 37.6 | — | 24 |
| 3 | 45 | 1.17 | 18.8 | 2.64 | 23 |
| 4 | 45 | 1.17 | 37.6 | 2.89 | 40 |
| 5 | 45 | 1.19 | 16.3 | 3.05 | 26 |
| 6 | 30 | 1.19 | 27.4 | 2.86 | 26 |
| 7 | 30 | 1.17 | 9.1 | 2.98 | 43 |
| 8 | 30 | 1.17 | 37.6 | 2.63 | 39 |

*"Exit Inh" is the inherent viscosity of polymer as it was poured onto the conveyer belt.

EXAMPLE 3

In this example, pulp was made by the process of this invention using an inclined support in the form of a conveyer. The surface of the conveyer was made from a fluoropolymer to facilitate removal of the gelled solution; and the conveyer was about 1.5 meters long and was set at an angle of about 45 degrees with the horizontal.

A PPD-T solution, as described above but at a polymer concentration of 9.4%, was poured at a rate of about 16.1 grams per second onto the bottom of the conveyer. The polymer in the solution had an inherent viscosity of about 1.1 dl/g. The conveyer was set to move at a speed of 16.5 centimeters per second—just enough to prevent the solution from running off of the lower end of the conveyer as the solution was poured. When the poured solution reached the top of the conveyer, the pouring was stopped and the conveyer was stopped. The solution was permitted to run back down the conveyer until it gelled and the viscosity was so high that it would no longer flow. About two minutes after stopping the conveyer, the gel was cut at intervals of about 1 to 2 centimeters transversely to the solution flow and the cut gel was transferred from the conveyer to an oven where it was heated at about 45° C. for 60 minutes.

Pulp was isolated from the gel by the same technique as was described in Example 1, above. The pulp exhibited a weighted and arithmetic average length of 0.74 and 0.32 mm, respectively, and had a surface area of 7 square meters per gram. Pulp lengths were determined using a Kajaani particle size distribution tester identified as Kajaani Model FS-100 sold by Valmet Automation Company, Finland; and the surface area was determined as a single point BET nitrogen adsorption using a Strolein Surface Area Meter.

EXAMPLE 4

In this example, also, pulp was made by the process of this invention using an inclined support in the form of a conveyer. The surface of the conveyer was made from a fluoropolymer to facilitate removal of the gelled solution; and the conveyer was about 1.5 meters long and was set at an angle of about 30 degrees with the horizontal.

A PPD-T solution, as described above but at a polymer concentration of 9.6%, was poured at a rate of about 16 grams per second onto the top of the conveyer. The polymer in the solution had an inherent viscosity of about 1.15 dl/g. The conveyer was set to move downward at a speed of 9.1 centimeters per second. When the poured solution reached the bottom of the conveyer, the pouring was stopped and the conveyer was stopped. The solution was permitted to run down the conveyer until it gelled and the viscosity was so high that it would no longer flow. The gel was cut at intervals of about 1 centimeter transversely to the solution flow and the cut gel was transferred from the conveyer to an oven where it was heated at about 45° C. for 60 minutes.

Pulp was isolated from the gel by the same technique as was described in Example 1, above. The pulp had an inherent viscosity of 2.81 dl/g and exhibited a suspension depth of 23 mm.

EXAMPLE 5

In this example, pulp was made by the process of this invention using a longer conveyer as the inclined support. The conveyer was about 6 meters long and was set at an angle of about 45 degrees with the horizontal.

A PPD-T solution, as described above but at a polymer concentration of 8.1%, was poured at a rate of about 18.7 grams per second onto the bottom of the conveyer. The polymer in the solution had an inherent viscosity of about 1.56 dl/g. The conveyer was set to move at a speed of 17.8 centimeters per second. When the poured solution reached the top of the conveyer, the pouring was stopped and the conveyer was stopped. The solution was permitted to run back down the conveyer until it gelled and the viscosity was so high that it would no longer flow. The gel was cut at intervals of about 1.1 centimeter transversely to the solution flow and the cut gel was transferred from the conveyer to an oven where it was heated at about 45° C. for 60 minutes.

Pulp was isolated from the gel by the same technique as was described in Example 1, above. The pulp had an inherent viscosity of 2.81 dl/g, exhibited a weighted and arithmetic average length of 1.06 and 0.42 mm, respectively, and had a surface area of 5.9 square meters per gram and a Canadian Standard Freeness of 682 milliliters. Canadian Standard Freeness determinations were made in accordance with TAPPI Standard T227 m-58.

EXAMPLE 6

In this example, pulp was made by the process of this invention using a conveyer having a shallow trough built thereon as the inclined support. The surface of the trough was made from a fluoropolymer to facilitate removal of the gelled solution. The trough was about 2.5 centimeters wide; and conveyer was about 1.5 meters long and was set at various angles with the horizontal.

A PPD-T solution, as described above but at a polymer concentration of 8.2%, was poured at a rate of about 17.8 grams per second into the trough at the bottom of the conveyer. The polymer in the solution had an inherent viscosity of about 1.2 dl/g. The conveyer was set to move at various speeds. There was no runoff from the conveyer at those speeds. When the poured solution reached the top of the conveyer, the pouring was stopped and the conveyer was stopped. The solution was permitted to run back down the conveyer until it gelled and the viscosity was so high that it would no longer flow. The conveyer was then started again and strips of the gel were removed from the conveyer and cut at intervals of about 1 centimeter transversely to the solution flow. The cut gel was transferred to an oven where it was heated at about 45° C. for 60 minutes.

Acceptable pulp (Items 1-7 of the table, below) was isolated from the gel by the same technique as was described in Example 1, above.

| Item | Angle (deg) | Conv. Speed (cm/s) | Mean Shear ($Sec^{-1}$) | Suspension Depth (mm) |
|---|---|---|---|---|
| 1 | 34 | 13.7 | 11 | 50 |
| 2 | 34 | 17.3 | 6 | 45 |
| 3 | 20 | 12.7 | 9 | 44 |
| 4 | 20 | 15.2 | 5 | 50 |
| 5 | 10 | 8.6 | 5 | 46 |
| 6 | 10 | 10.7 | 3 | 39 |
| 7 | 34 | 12.2 | — | 49* |

*This item was conducted without a trough on the conveyer

For the purpose of calculating Mean Shear Rate using the equations set out thereinabove, the density of the solution was taken as 1.05 g/cc and the surface velocity of the flowing liquid was determined by measuring the time for a particle floating on the surface of the liquid to travel about 15 centimeters after contact with the inclined support.

EXAMPLE 7

In this example, pulp was made by the process of this invention using a conveyer having a shallow trough built thereon as the inclined support. The surface of the trough was made from a fluoropolymer to facilitate removal of the gelled solution. The trough was about 2.5 centimeters wide; and conveyer as about 6 meters long and was set at an angle of about 10 degrees with the horizontal.

A PPD-T solution, as described above but at a polymer concentration of 8.35%, was poured at a rate of about 18.1 grams per second into the trough at the bottom of the conveyer. The polymer in the solution had an inherent viscosity of about 1.2 to 1.4 dl/g. The conveyer was set to move at a speed of 5.6 to 12.2 centimeters per second. There was no runoff from the conveyer at those speeds. When the poured solution reached the top of the conveyer, the pouring was stopped and the conveyer was stopped. The solution was permitted to run back down the conveyer until it gelled and the viscosity was so high that it would no longer flow. The conveyer was then started again and strips of the gel were removed from the conveyer about 1 to 1.5 meters long. The strips were cut at intervals of about 1 centimeter transversely to the solution flow and the cut gel was transferred from the conveyer to an oven where it was heated at about 45° C. for 60 minutes.

Pulp was isolated from the gel by the same technique as was described in Example 1, above. The pulp had an inherent viscosity of 2.71 to 3.26 dl/g, a surface area of 7 square meters per gram, and a Canadian Standard Freeness of 750 milliliters.

EXAMPLE 8

In this example, pulp was made by the process of this invention using the device of Example 7 except that the conveyer was wrapped with heating blankets to maintain the temperature on the conveyer at 40° to 70° C. along 6.1 meters of its length.

A PPD-T solution, as described above but at a polymer concentration of 8.5%, was poured at a rate of about 17.8 grams per second into the trough at the bottom of the conveyer. The conveyer was set to move at a speed of 8.3 centimeters per second—enough to prevent the solution from running off of the lower end of the conveyer as the solution was poured. When the poured solution reached the top of the conveyer, the pouring was stopped and the conveyer was stopped for the time necessary for the solution to gel. The conveyer was then started again and strips of the gel were removed from the conveyer about 1 to 1.5 meters long. The strips were cut at intervals of about 1 centimeter transversely to the solution flow and the cut gel was transferred from the conveyer to an oven where it was heated at about 45° C. for 60 minutes.

Pulp was isolated from the gel using a hammer mill equipped with a full hammer stack.

The pulp had an inherent viscosity of 3.3 dl/g, a surface area of 3.4 square meters per gram, and a Canadian Standard Freeness of 750 milliliters.

The pulp product of this example was refined in a laboratory refiner to further modify the physical properties of the pulp. The refiner was a disk refiner made by Sprout-Bauer with a 30 centimeter diameter. The plate pattern was identified as #18034.

A suspension of 200 grams of the pulp in 6 liters of water was poured into a screw feeder which fed the refiner running at a disk speed of 1800 rpm with a gap of 0.64 mm between the plates. The suspension was collected in a bucket and was passed through the refiner again. The gap between the plates was reduced to 0.38 mm and the suspension was passed through the refiner 15 more times. The gap was then reduced to 0.25 mm and the suspension was passed through the refiner 20 more times.

The surface area of the resultant pulp was 9.4 square meters per gram and the Canadian Standard Freeness was 498 milliliters.

EXAMPLE 9

In this example, a series of runs was made using the inclined support of Example 8, above, and varying the polymer concentration, the conveyer speed, and the incubation time. The solution density was 1.05 g/cc and the solution was poured at rates of 18.9 g/sec for Items 1-3, 22.3 g/sec for Items 4 and 5, and 25.6 g/sec for Item 6, in the table, below.

The pulp was isolated from the gel by the same technique as was described in Example 1, above.

| Item | Soln (%) | Inh Visc (dl/g) Soln | Inh Visc (dl/g) Pulp | Conv Speed (cm/s) | Incub Time (hr) | Susp. Depth (mm) | Mean Shear ($Sec^{-1}$) |
|---|---|---|---|---|---|---|---|
| 1 | 8 | 1.68 | 3.18 | 7.7-8.1 | 6 | 53 | 3 |
| 2 | 8 | 1.58 | 3.55 | 8.6 | 6 | 40 | 4 |
| 3 | 8 | 1.75 | 3.96 | 7.4 | 6 | 57 | — |
| 4 | 6.8 | 1.48 | 3.75 | 6.6 | 8 | 35 | 2 |
| 5 | 6.8 | 1.62 | 3.09 | 7.1 | 8 | 46 | 2 |
| 6* | 5.9 | 1.62 | 3.94 | 8.1 | 8 | 15 | 3 |

*This item is not an example of the invention because the solution concentration was below that which was required to obtain an adequately anisotropic system.

EXAMPLE 10

In this example, a series of pulps was made by the process of this invention using a device similar to that of Example 7 except that the conveyer was 12.8 meters long with a 10 degree angle and was wrapped with heating blankets along 6.1 meters of its length to maintain the temperature on the conveyer at 40° to 50° C. The conveyer was run continuously and the gel was removed from the conveyer continuously.

PPD-T solutions, as described above but at polymer concentrations indicated in the table of this example, were poured at a rate of about 14.1 to 20.2 grams per second into the trough at the bottom of the conveyer. The conveyer was set to move at various speeds adequate to prevent run off at the lower end of the conveyer and, yet, permit gellation of the solution before it reached the top of the conveyer. At the top of the conveyer, the gel was cut at intervals of about 2 centimeters transversely to the solution flow using a rotating wire cutter. The cut gel was placed in an oven where it was heated at about 46°-51° C. for 8 hours. Pulp was isolated from the gel by the same technique as was described in Example 1, above. The pulp exhibited inherent viscosities and suspension depths as indicated in the table. The solution density was 1.05 g/cc and the solution was poured at rates of 14.1 g/sec for Item 1, 15.8 g/sec for Items 2 and 3, 17.6 g/sec for Items 4 and 5, and 20.2 g/sec for Item 6, of the table, below.

| Item | Soln (%) | Inh Visc (dl/g) Soln | Inh Visc (dl/g) Pulp | Conv Speed (cm/s) | Susp. Depth (mm) | Mean Shear ($Sec^{-1}$) |
|---|---|---|---|---|---|---|
| 1 | 10.7 | 1.46 | 4.0 | 5.3 | 50 | 2 |
| 2 | 9.6 | 1.29 | 2.9 | 6.7 | 58 | 3 |
| 3 | 9.6 | 1.47 | 3.4 | 7.6 | 54 | 3 |
| 4 | 8.6 | 1.34 | 3.2 | 8.4 | 53 | 4 |
| 5 | 8.6 | 1.53 | 3.5 | 7.9 | 53 | 4 |
| 6 | 7.5 | 1.51 | 3.1 | 8.1 | 56 | — |

EXAMPLE 11

In this example, a series of pulps was made by the process of this invention using the device of Example 10.

A PPD-T solution at a polymer concentration of 10.7%, was poured at a rate of about 35.4 grams per second onto the bottom of the conveyer. The conveyer was set to move at various speeds adequate to prevent run off at the lower end of the conveyer and, yet, permit gellation of the solution before it reached the top of the conveyer. At the top of the conveyer, the gel was cut at intervals of about 2.5 centimeters transversely to the solution flow using a rotating wire cutter. The cut gel was placed in an oven where it was heated at about 49° C. for 8 hours. Pulp was isolated from the gel by the same technique as was described in Example 1, above. The pulp exhibited inherent viscosities and suspension depths as indicated in the table, below.

| Item | Inh Visc (dl/g) Soln | Inh Visc (dl/g) Pulp | Conv Speed (cm/s) | Susp. Depth (mm) | Mean Shear ($sec^{-1}$) |
|---|---|---|---|---|---|
| 1 | 1.12 | 3.7 | 12.2 | 44 | 4 |
| 2 | 1.07 | 3.9 | 12.8 | 50 | 4 |
| 3 | 0.89 | — | 11.9 | 52 | 4 |

The solution density was 1.05 g/cc and the surface velocity was determined to be 6.1 cm/sec.

We claim:

1. A method for producing a para-aramid pulp comprising:

a) establishing a polymerizing para-aramid solution;

b) pouring the solution on an inclined support having an angle from 5 to 75 degrees with the horizontal and adequate to cause orientation of polymer chains in the solution through the shear force of gravity due to flow of the solution;

c) maintaining the solution on the support until the solution gels;

d) isolating para-aramid pulp from the gel.

2. The method of claim 1 wherein the inclined support is moving.

3. The method of claim 2 wherein the inclined support is moving upward.

4. The method of claim 1 wherein the flow of the solution is entirely due to gravitational forces.

5. The method of claim 1 wherein the gelled solution from step c) is cut at selected intervals transversely with respect to the flow of the solution.

6. The method of claim 2 wherein the inclined support is a moving conveyer.

7. The method of claim 6 wherein the moving conveyer is a trough.

8. The method of claim 6 wherein the moving conveyer is concave.

9. The method of claim 6 wherein the flow of the solution is such that the solution is subjected to a mean shear of 2 to 15 $sec^{-1}$.

10. The method of claim 1 wherein the flow of the solution is such that the solution is subjected to a mean shear of 1 to 35 $sec^{-1}$.

11. The method of claim 1 wherein the para-aramid is poly(p-phenylene terephthalamide).

12. The method of claim 11 wherein the poly(p-phenylene terephthalamide) has an inherent viscosity of 0.5 to 2.2 dl/g in the solution as it is poured on the inclined support.

13. The method of claim 11 wherein the poly(p-phenylene terephthalamide) has an inherent viscosity of 0.7 to 2.0 dl/g in the solution as it is poured on the inclined support.

14. The method of claim 5 wherein the gel is incubated while it is on the support before it is cut.

15. The method of claim 5 wherein the gel is incubated after it is cut.

16. The method of claim 1 wherein said polymerizing solution is caused to flow while maintaining the temperature of the solution between about 15° C. and about 60° C.

17. The method of claim 14 wherein the incubating is performed at a temperature of between about 25° C. and about 60° C.

18. The method of claim 15 wherein the incubating is performed at a temperature of between about 25° C. and about 60° C.

19. A method for producing a para-aramid pulp comprising:

a) establishing a liquid, actively-polymerizing solution containing polymer chains of a para-aramid by contacting with agitation substantially stoichiometric amounts of aromatic diacid halide consisting essentially of a para-oriented aromatic diacid halide and aromatic diamine consisting essentially of a para-oriented aromatic diamine in a substantially anhydrous amide solvent system;

b) pouring the liquid solution, when the inherent viscosity of the para-aramid is between about 0.5 and about 2.2 dl/g, on an inclined support having an angle from 5 to 75 degrees with the horizontal and adequate to cause orientation of polymer chains in the solution through the shear force of gravity due to flow of the solution;

c) maintaining the solution on the support for at least a duration sufficient for said solution to become a gel;

d) cutting the gel at selected intervals transversely with respect to the flow of the solution;

e) isolating para-aramid pulp from the gel.

20. The method of claim 19 wherein the gel is incubated while it is on the support before it is cut.

21. The method of claim 19 wherein the gel is incubated after it is cut.

22. The process of claim 19 wherein said solvent system comprises N-methyl pyrrolidone and calcium chloride.

23. The method of claim 19 wherein the para-aramid is poly(p-phenylene terephthalamide).

24. A method for producing a para-aramid pulp comprising:

a) establishing a liquid, actively-polymerizing solution containing polymer chains of a para-aramid by contacting with agitation substantially stoichiometric amounts of aromatic diacid halide consisting essentially of a para-oriented aromatic diacid halide and aromatic diamine consisting essentially of a para-oriented aromatic diamine in a substantially anhydrous amide solvent system;

b) pouring the liquid solution, when the inherent viscosity of the para-aramid is between about 0.5 and about 2.2 dl/g, on an inclined support having an angle from 5 to 75 degrees with the horizontal and adequate to cause gravitational flow of the solution which produces an optical anisotropic liquid solution containing domains of polymer chains within which the polymer chains of para-aramid are substantially oriented in the direction of flow;

c) maintaining the solution on the support for at least a duration sufficient for said solution to become a gel;

d) cutting the gel at selected intervals transversely with respect to the flow of the solution;

e) isolating para-aramid pulp from the gel.

25. The method of claim 24 wherein the gel is incubated while it is on the support before it is cut.

26. The method of claim 24 wherein the gel is incubated after it is cut.

27. The method of claim 24 wherein said solvent system comprises N-methyl pyrrolidone and calcium chloride.

28. The method of claim 24 wherein the para-aramid is poly(p-phenylene terephthalamide).

29. A method for producing a para-aramid pulp comprising:

a) establishing a polymerizing para-aramid solution;

b) pouring the solution on an inclined support which is moving upward at an angle with the horizontal adequate to cause orientation of polymer chains in the solution through the shear force of gravity due to flow of the solution.

c) maintaining the solution on the support until the solution gels;

d) isolating para-aramid pulp from the gel.

* * * * *